US005709610A

United States Patent [19]

Ognjanovic

[11] Patent Number: 5,709,610

[45] Date of Patent: Jan. 20, 1998

[54] GOLF CLUB/BALL IMPACT DETECTION SYSTEM

[76] Inventor: Zivota Ognjanovic, 35920 42nd St. E., Palmdale, Calif. 93552

[21] Appl. No.: 758,550

[22] Filed: Nov. 29, 1996

[51] Int. Cl.[6] ..... A63B 69/36

[52] U.S. Cl. ..... 473/223; 473/409; 473/220

[58] Field of Search ..... 473/223, 224, 473/220, 409

[56] References Cited

U.S. PATENT DOCUMENTS

| | | | |
|---|---|---|---|
| 4,088,324 | 5/1978 | Farmer | 473/223 |
| 4,898,389 | 2/1990 | Plutt | 473/223 |
| 5,209,483 | 5/1993 | Getney et al. | 473/223 |

FOREIGN PATENT DOCUMENTS

| | | | |
|---|---|---|---|
| 2000536 | 1/1977 | Japan | 473/223 |

*Primary Examiner*—George J. Marlo

*Attorney, Agent, or Firm*—Barbara R. Greenberg

[57] ABSTRACT

A golf club/golf ball impact detection system contained entirely within a golf club head for immediate visual indication of specific club face and golf ball impact location comprising a plurality of push button members that can be depressed by a golf club/golf ball impact to impinge on an adjustable electrical conducting board, where an electrical circuit is completed to illuminate a plurality of push button associated LEDs, that remain illuminated until a reset switch is manually depressed or an internal integrated circuit provides timing means. The golf club/golf ball impact detecting system is used not only for practicing golf but also used under the pressure of actual play.

9 Claims, 4 Drawing Sheets

GOLF CLUB/BALL IMPACT DETECTION SYSTEM

FIELD OF THE INVENTION

This invention relates generally to the field of golf clubs, and, more specifically, to golf clubs such as putters, "woods" and irons that are slightly modified to teach the user as he or she practice golf but, also, to assist the user who is actually involved in a round of golf. The invention enables a golfer to receive instantaneous visual feedback regarding the specific location of club face impact on a golf ball.

BACKGROUND OF THE INVENTION

In playing the game of golf, it is necessary to master many skills related to the golfer's swing. The entire cycle of the golfer's swing determines the excellence or failure of a particular golf stroke. Included in the golfer's swing is body muscle movement, a downward arc swing, ball contact and a follow through in an upward arc figure. The ball contact point is a major factor that determines whether or not the ball will travel in the golfer's intended direction and distance. When the golfer's club makes impact with a golf ball on the club face center, the so called "sweet spot", and achieves an intended stroke, he or she would like to repeat that event. It is necessary that the golfer imprints a good golf stroke in his or her mind, retains a neurological memory of the good stroke and also develops muscle memory that allows easy repetition of the stroke. There is also a third factor that allows the golfer to repeat a good stroke; the golfer's state of mind. This involves the golfer's confidence in knowing that a good stroke is achievable.

Instant knowledge of the specific point of impact of the gold ball on the club face allows the golfer to immediately analyze his or her stroke, repeat a good stroke using feedback on the golf ball impact point, and rapidly develop neurological and muscular memory and the confidence needed to repeat a good stroke. In the putting stroke, ball contact with lower half of the club face will cause the ball to roll slowly while ball contact with the top half of the putter face will move the golf ball more rapidly. A small error in impacting the ball on the putter "sweet spot", the club face center, will either cause the ball to drift away from an intended path to a hole or impair an intended ball distance to the hole. A very small inaccuracy in the ball impact zone can move the ball in a direction and place it at a distance far from the hole. Regarding a golfer's other clubs, mainly "woods" which are usually not wooden but constructed of metal alloys or graphite and irons, a ball impact with a wood or iron "sweet spot" imparts maximum swing kinetic energy transfer to the ball which moves on a direct, controlled line to a desired location on a golf course. With instant feedback of ball impact point on a club face, there will be a neurological, muscular and psychological transfer to the golfer relating to a successful golf stroke which will allow repetition of the good golf stroke.

In the present invention, a full set of golf clubs including a putter, "woods" and irons are slightly modified so as not to influence club balance, weight, feel and durability, but equipped with visual illumination to instantly signal to the golfer the point of ball impact on the club face. The golfer, using a set of modified clubs, can work with an instructor on golf stroke improvement and then use the same clubs while playing a round of golf. The club face ball impact point information conveyed to the golfer during instruction as a visual light signal will continue while the golfer plays. The visual signal is easily observed in daylight and not affected by temperature extremes. During both practice and while playing, the golfer is constantly receiving ball impact placement feedback which leads to good golf stroke repetition. In addition, the golfer is inclined to keep his or her head down during impact in order to immediately receive ball impact point information from the light signal There are many golf club teaching devices that provide club stroke information to the golfer. The type of information provided and the means for receiving the information vary considerably in the prior art. A search of golf training devices with indicator lights that illuminate for a brief time after golf club impact disclosed the following U.S. patents:

| U.S. Pat. No. | Date | Inventor |
|---|---|---|
| 3,182,508 | May 11, 1965 | Varju |
| 3,436,076 | April 1, 1969 | Barthol |
| 4,088,324 | May 9, 1978 | Farmer |
| 4,306,722 | December 22, 1981 | Rusnak |
| 4,898,389 | February 6, 1990 | Plutt |
| 4,940,236 | July 10, 1990 | Allen |
| 5,080,362 | January 14, 1992 | Lillard |
| 5,230,512 | July 27, 1993 | Tattershall |
| 5,441,269 | August 15, 1995 | Henwood |

Varju, U.S. Pat. No. 3,182,508 discloses a specially constructed golf club capable of transmitting an electrical signal proportional to ball impact magnitude to a remote receiving device. No information on ball impact point is transmitted.

Farmer, U.S. Pat. No. 4,088,324 discloses a golf club having an acceleration sensor mounted in the club head that impacts with a golf ball and transmits an electrical signal that results in a ball travel distance read out. However, no ball impact location is given.

Rusnak, U.S. Pat. No. 4,306,722 discloses a light reflective apparatus that indicates the club face angle at the time of impact.

Plutt, U.S. Pat. No. 4,898,389 discloses a golf training device to be clipped on a golf club head. The force of the impact of a club face transducer on a golf ball determines the area of golf ball impact. In the present invention, force of impact has no affect on the determination of ball impact location.

Henwood, U.S. Pat. No. 5,441,269 discloses a sensor for electronically detecting any abnormal acceleration or deceleration of a golf putter during a putting stroke.

Allen, U.S. Pat. No. 4,940,236 related to a computer golf club with a transducer built into the forward face of a metal club that produces signal and processing circuitry that translate the signal into the impact force and duration of impact between the ball and the club to determine the travel distance of the golf ball.

Tattershall, U.S. Pat. No. 5,230,512 shows the use of LEDs for illuminating a golf club swing path and indicating the position of the golf club head as it swings through a golf ball contact zone but does not indicate the impact location of the ball on the club head.

Barthol, U.S. Pat. No. 3,436,076 and Lillard, U.S. Pat. No. 5,080,512 relate to point of impact indicating devices for baseball bats and tennis rackets, respectively.

In summary, none of the references cited above, either in combination or taken separately, define a playing and teaching golf club that utilizes a push button mechanical device to transmit electrical signals to actuate red, green and yellow LEDs, so that a club head face impact with a golf ball results in instant information to the golfer concerning specific ball impact location on a club head face. In addition, since the present invention ball impact point detection system fits compactly and is securely inserted in a golf club head, the system cannot be damaged by a club's continual force of impact on a stationary golf ball. Also, the present invention's impact detection system does not rely on the amount of force transferred from the club to the ball, and, thus, works equally well for putting and for driving the ball with "woods" or irons. Another distinguishing feature of the present invention is the impact point detection system activated colored lights instantly visible to the golfer who has his or her head down at the time of golf club impact on a golf ball. The activated lights turn on at the instant of ball impact and remain on for a preset time, about fifteen to twenty seconds after club impact on the ball, so the golfer receives immediate and continual visual feedback on the results of his or her stroke. This visual stimulation translates into neurological memory and muscle memory and the golfer has a psychological advantage in knowing that a good stroke can be repeated.

It is therefore an object of the present invention to provide conventional golf clubs with minimal modification comprising a golf club/ball impact detection system that is contained within the golf club head in order to allow the golfer to practice and play with these clubs while receiving immediate visual feedback concerning the club face impact point with a golf ball so that the golfer can make immediate adjustments and repeat with confidence a good stroke while practicing or during the pressure of actual playing conditions.

Another object of the present invention is to provide the golfer with a set of teaching golf clubs that can be used for practice and play.

A further objective of the present invention is to provide the golfer with a durable club modification that will give constant feedback on ball impact location that will not break down even after years of hard use.

A still further object of the present invention is to provide club face point of impact visual information that does not depend on the force of club contact on a ball but is consistent regardless of club force.

Another object of the invention is to provide immediate visual information on club point of impact by illumination of red, green and yellow LEDs that remain on for a predetermined time such as fifteen to twenty seconds and tell the golfer precisely where the ball impacted on the club face so the golfer can achieve golf stroke neurological and muscle memory and the confidence to repeat good strokes.

SUMMARY OF THE INVENTION

The present invention disclosed herein comprises a conventionally designed golf club head where the club face wall contains a plurality of circular apertures that are fitted to slidingly receive push button members, each having a head portion and a shaft portion, the shaft portion distal end fitted with a partially relaxed coiled spring arranged to urge the push button contact member head portion slightly above the club face surface. Compression of a push button member head portion, preferably by club head contact with a golf ball, will instantly move the push button member shaft portion proximal end to make contact with an adjustable electrical conducting contact board and also increase torsion in the partially relaxed coiled spring. Next, as the golf ball is released from the club face, spring torsion is diminished and the coiled spring relaxes allowing the push button shaft to leave the contact board as the spring again urges the push button head slightly above the club face surface. A safety ting around the push button shaft portion holds the push button member in this position and prevents the push button member from flying out of the circular aperture.

The adjustable electrical conducting contact board is attached to the club head top wall through the wall's inner surface with four corner located spring loaded screws. The contact board is placed at a distance slightly below the push button member's shaft portion end tip, ideally between 0.020 inch and 0.040 inch. When the push button member's head portion is depressed, the shaft portion proximal end touches the electrical conducting contact board and a circuit is completed for conductivity to illuminate a particular LED. Between the contact board and the club face wall inner surface at the place of screw insertion, energy absorbing spacers that can be made of a high density plastic material or an energy absorbing material such as hard rubber are inserted. The energy absorbing spacers minimize contact board vibration that occurs when the club face impacts a golf ball and the spring loaded corner screws provide contact board flexibility so steady contact is made by the depressed push button shaft portion end with the contact board no matter what amount of force is applied to the push button member.

A technical advantage of the present invention is the relatively simple electrical circuit apparatus on a circuit board that can be reduced to about the size of a large postage stamp. Regarding the electrical circuit apparatus, when the push button shaft end is in contact with the electrical conducting contact board, the electrical circuit is completed. The electrical conducting contact board is wired to the circuit board by a plurality of conducting wires. Also, a power source, preferably a six volt battery, part of the electrical circuit apparatus, provides sufficient voltage on gate switch contacts to turn on SCRs, silicon controlled rectifiers, that conduct within a particular range of current and voltage, which, in turn, cause a plurality of light emitting diodes, LEDs, to illuminate until such time as a reset switch is depressed. The SCRs are solid state electronic switches that can continue to function over a period of about fifty years no matter how many time they are turned on and off. SCRs are unaffected by radiation and magnetic forces and SCRs function at a wide range of temperatures. This present invention circuit arrangement is extremely accurate and reliable. Regarding the reset switch, upon depression, a reset switch shaft portion with an associated conducting plate moves to separate from a permanently located conducting plate and the electrical circuit is broken resulting in the cessation of LED illumination. The golfer chooses the length of LED illumination. Also, the golfer can execute reset switch depression by hand or by foot.

In another embodiment, the reset switch and associated electrical circuit apparatus is replaced by a more complex electrical circuit apparatus comprising an integrated circuit with an instant response IC timer, known commercially as a NE555 timer, with the timing interval controlled by an external resistor and capacitor circuit, both the timer and the circuit well known in the art. The IC timer can be preset to a particular length of time, preferably fifteen to twenty seconds, for the LEDs to be illuminated before the external circuit is automatically reset. A NE556 timer having two NE555 silicon chips on a single silicon chip can replace the NE555 timer in order to produce a preset timed illumination.

In a preferred embodiment, the LEDs are arranged in two groups of three projecting through suitable apertures located on the golf club head front wall top. A group of six push button members with circular shaped heads are arranged in rows of three so that three cover the top portion of the club face center, the "sweet spot", and three cover the bottom portion of the club face center "sweet spot". Each push button head top surface edge is adjacent to neighboring push button head surface edges. When a golf club "sweet spot" makes contact with a golf ball, a portion of the ball surface smaller than the push button top surface is making contact. Therefore, an impact on the "sweet spot" will result in an impact on a particular push button resulting in the illumination of an associated LED and the transfer to the golfer information regarding the location of the ball impact on the club face. If the golf club head/golf ball impact occurs where push button surface edges meet, more than one LED will be simultaneously illuminated and the golfer will still know the location of ball impact. Also, if a golf club/ball impact results in time delayed push button impacts, where a first push button is depressed and almost simultaneously a second push button is depressed, associated LEDs will illuminate in the order of impact.

Push button members and LEDs are related as described herein. The top three push button members are associated respectively with green, red and yellow High Brightness LED microlamps located on the front surface wall top left portion and the bottom three push button members are associated respectively with green, red and yellow High Brightness LED microlamps located on the front surface wall top right portion. High Brightness LED lamps when illuminated are highly visible in bright daylight as well as in darker environments. The number of push button members used and the number of associated LEDs is dependent on the club head size and analogous "sweet spot" size.

When a golf club "sweet spot" impacts a golf ball, the push button member impacted is depressed, contact is made with the adjustable electrical conducting board, power from a battery source turns on the SCR and the LED associated with the push button member is illuminated. The golfer has instant information as to the exact location of the golf ball impact on the golf club face and can make appropriate stroke adjustments to correct a poor stroke or retain muscle memory to repeat a good stroke. The LED illumination in subsequent strokes will act as a teacher for golf stroke improvement.

The top and bottom push button member arrangement on a putter with associated LED illumination teaches the golfer that club/ball impact with bottom push button members results in short distance ball travel as compared to club/ball impacts with top push button members where ball travel distance is longer. LED illumination on iron and "wood" club heads will also alert the golfer when club/ball impact is with the bottom push buttons and the ball is "topped" thereby traveling a short distance.

For all golf clubs, putters, irons and "woods", the number of push button members and associated LEDs can vary depending on the club design and golfer's expertise. A beginning golfer may prefer additional push button members in each row to obtain feedback on club/ball impact away from the "sweet spot". Also, push button head designs can vary. A square push button head design eliminates any space between push button top surfaces so a club/ball impact will result in very accurate ball impact location and a diamond shaped push button head design can locate the exact center of the "sweet spot". In addition, any push button head surface can be grooved to conform to a conventional golf club head front surface design. Grooving will not influence push button member depression and ball impact location.

There is a need for a set of teaching and playing golf clubs which will provide instant feedback to a golfer regarding precise club/ball impact position on a golf club face so that the golfer can quickly achieve muscle memory for repetitive good strokes and make immediate corrections to improve poor strokes.

DETAILED DESCRIPTION OF THE INVENTION

Figure 2:
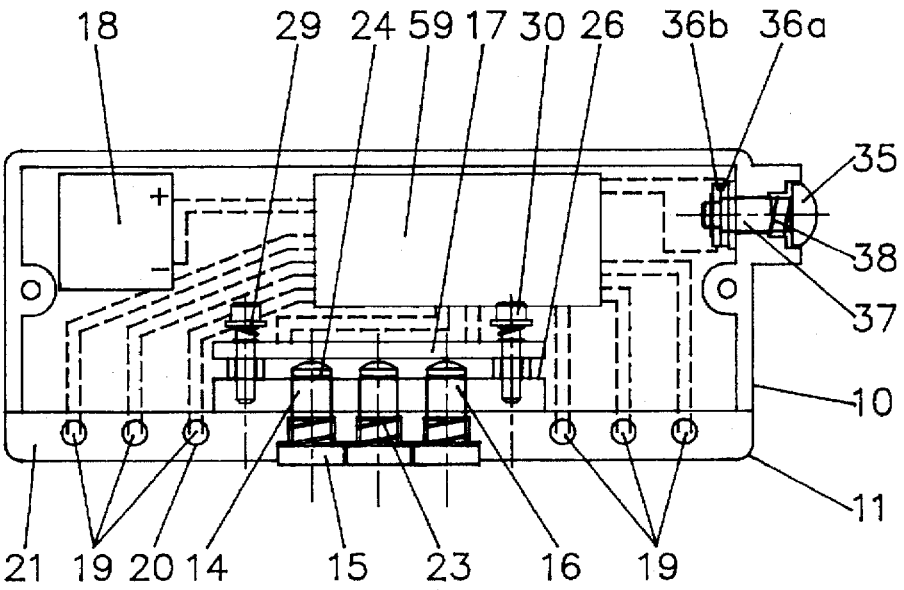
FIG. 2 is a top view of the preferred embodiment of the present invention show the reset switch.
Figure 1:
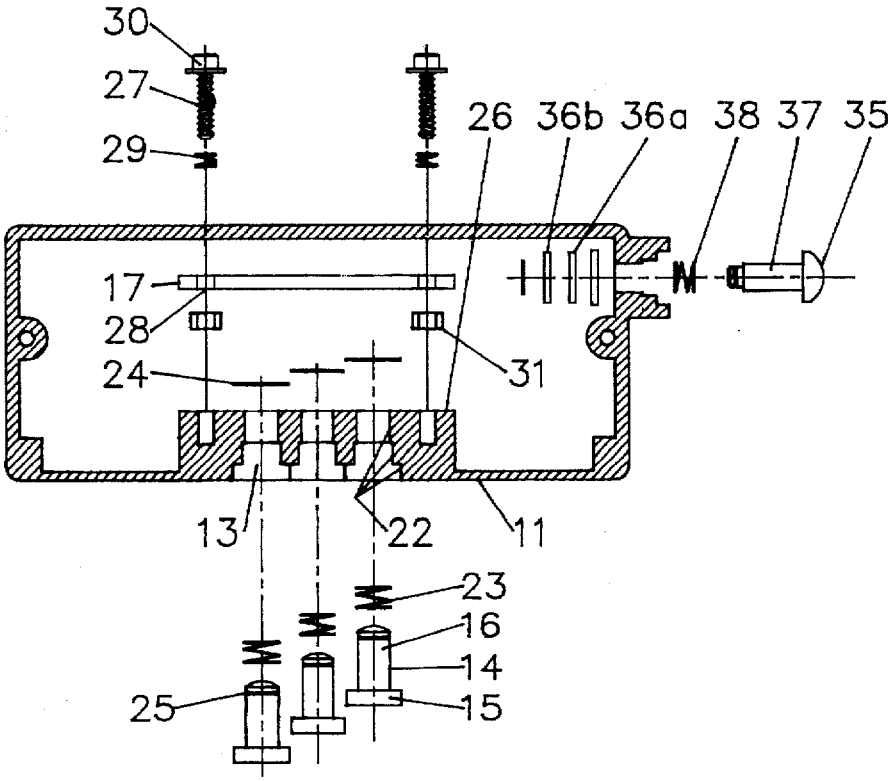
FIG. 1 is an exploded top view of a conventional putter showing movable part construction and the reset switch open position.

Referring to the drawings and, particularly to FIGS. 1 and 2, a golf club/golf ball impact detection system 10 is illustrated in conjunction with a putter 11. However, the version, as illustrated in FIGS. 1 and 2, can be successfully embodied in other conventional clubs such as "woods" and irons. The golf club/golf ball impact detection system 10 generally comprises a club face 12 containing a plurality of circular apertures 13 receiving slidingly a plurality of push button members 14 as seen in detail in FIG. 1. Upon depression of a push button member 14 head portion 15 caused by impact with a golf ball, a push button member 14 shaft portion 16 proximal end will impinge on an adjustable electrical conducting contact board 17 (See FIG. 7) having a power source such as a battery 18, preferably producing six volts, to send a signal through the circuitry to cause an associated light emitting diode (LED) 19 to illuminate, a plurality of said LEDs 19 located within a plurality of circular openings 20 in the club face 12 front wall top ridge 21, where said LEDs are visible to a golfer watching a golf club head make contact with a golf ball.

Referring to FIG. 1, within circular apertures 13 are coaxial counterbores 22 sized first to slidingly receive the push button head 15 and then narrowed to receive the push button shaft portion 16. When the push button member 14 is depressed, the head portion 15 stops at a narrower counterbore. Also, upon depression, a partially relaxed coiled spring 23, fitted to encircle a shall portion 16 distal end, is compressed to stop where a larger diameter counterbore and a smaller diameter counterbore meet increasing spring torsion. Upon push button member 14 release, coiled spring 23 torsion diminishes and the coiled spring 23 expands urging the push button member 14 upward. In order to prevent total push button member 14 separation from the golf club face 12, a safety ring 24 is provided that tightly adheres to a shaft portion 16 proximal end retainer notch 25, the safety ring 24 placed to stop the push button member 13 head portion 14 so that it will protrude approximately 0.020 to 0.040 inch above the club face 12.

Referring to FIGS. 1 and 2, the adjustable electrical conducting board 17 is suspended from the golf club front wall inner surface 26 by screw means, said screws 27 inserted through the conducting board 17 corner portions 28 upward into the club front wall inner surface 26 so positioned to leave a space between the conducting board 17 and front wall inner surface 26 where the undepressed button shaft portion 16 proximal end tip will not reach the conducting board 17 until depression occurs. The screws 27 are fitted with partially relaxed coiled springs 29 placed between a screw head 30 and the conducting board 17 to impart flexibility to the conducting board 17 position as an impact force causes the push button shaft portion 16 proximal end tip to impinge on the conducting board 17 (See FIG. 7) where the conducting board 17 flexibility allows continuous contact as long as the impact force is applied. In addition, between the conducting board 17 and the front wall inner surface 26, the screws 27 penetrated shock absorbing material 31 so placed to absorb excess force from a powerful golf club/golf ball impact so that any change in impact force will not affect the golf club/golf ball impact detection system 10. The shock absorbing material 31 can be hard rubber or a derivative thereof or a plastic like absorbing material. The conducting board 17 should be made of an electrical conducting material such as a transition metal alloy.

Figure 3:
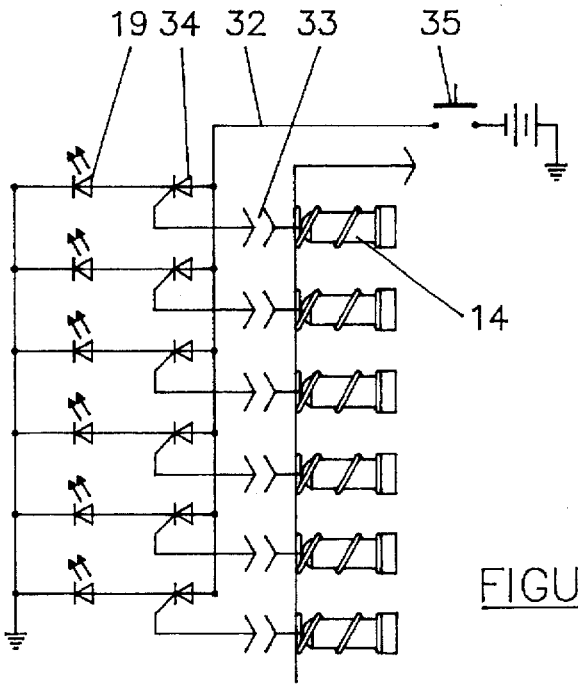
FIG. 3 is a schematic representation of the electrical circuit apparatus for the preferred embodiment of the invention showing the reset switch in an open position integrated into the electrical circuit apparatus.

The conducting board 17 is wired to an electrical circuit apparatus 32 on circuit board 59 that is schematically set forth in FIG. 3 and depicts six identical electrical circuits that will enable six push button members 14 to activate six associated light emitting Hi Bright LEDs 19, a preferable light source highly visible in daylight, to signal golf club/golf ball impact position on the club face 12. A plurality of electrical circuits, push button members 14 and LEDs are possible. Regarding the electrical circuit arrangement 32, desirably a six volt battery 18 or possibly two three volt lithium batteries connected in series, provide electrical power to the electrical conducting board 17 circuit apparatus 32 where push button member 14 shaft portion 16 proximal end tip contact triggers a gate switch contact 33 to activate a silicon controlled rectifier (SCR) 34 which energizes an LED 19. In the preferred embodiment, the electrical circuit apparatus 32 would be on one circuit board 59 about 1.0 inch by 1.0 inch. In this embodiment, the electrical circuit apparatus 32 is fitted with a reset switch 35, which can be manually disconnected as shown in FIG. 1, in order to turn off LEDs 19 after they are illuminated by push button member 14 impact with a golf ball that completes the electrical circuit 32. After reset switch 35 is manually depressed by hand or foot, it automatically reconnects, see FIG. 2, with reset switch 35 contact plates **36*a* and 36*b* adjacent and touching, ready to conduct an electrical current on subsequent circuit completion by a push button member 14** golf ball impact.

Referring to FIG. 1, to disconnect reset switch 35, shaft 37 is manually depressed so that coiled spring 38 is compressed in cooperation with contact plate **36*a* thereby separating contact plate 36*a* from contact plate 36*b* and turning off LED 19. Upon release of reset switch 35, shaft 37 moves back to its original position since coiled spring 38 tension decreases and contact plates 36*a* and 36*b*** touch and are in a position ready for electrical conduction from the next golf club/ball impact.

Figure 4:
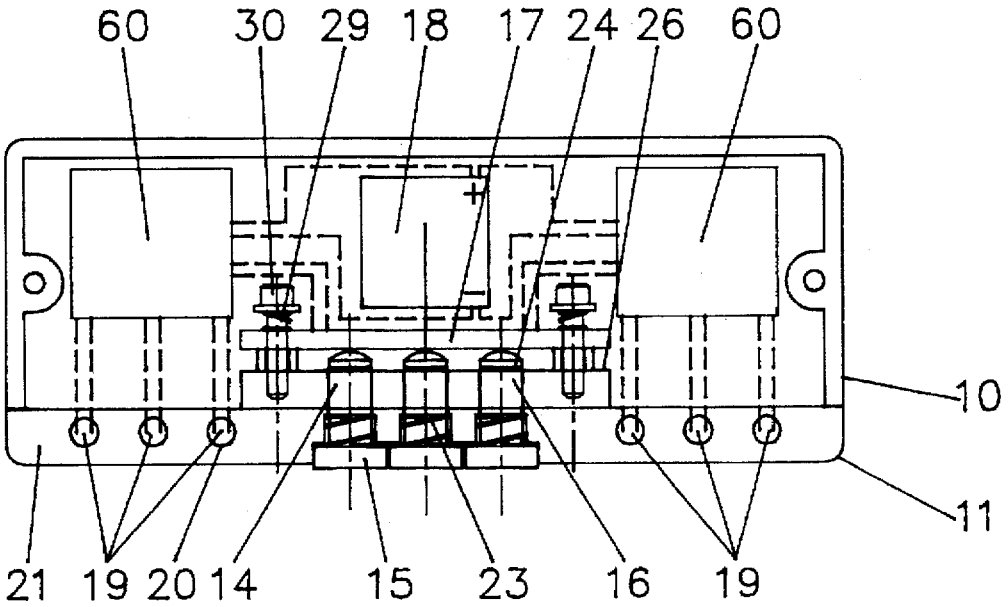
FIG. 4 is a top view of another embodiment of the present invention where an instant response timer replaces the reset switch.
Figure 5:
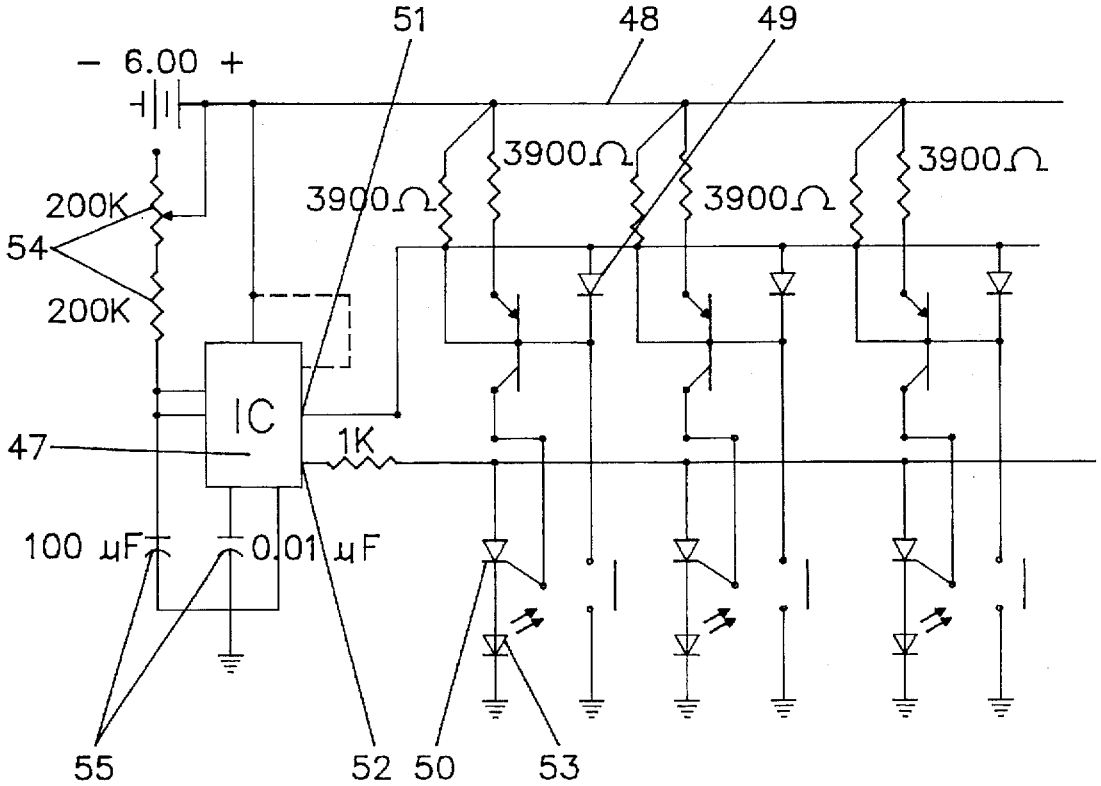
FIG. 5 is a schematic representation of the electrical circuit apparatus comprising the instant response timer and a network of capacitors and resistors.

In another embodiment of the present invention, see FIGS. 4 and 5, the reset switch 35 and electrical circuit apparatus 32 are omitted and replaced with electrical circuit apparatus 48 and an instant response timer IC 47, known commercially as a NE555 timer and sold by Motorola as MC1455, so that depression of a push button member 14 completes the electrical circuit apparatus 48, such as the one depicted in FIG. 5 on circuit board 60 shown in FIG. 4, so that flowing electrical current turns on diode 49 in order to block the electrical current from flowing into connected repetitive circuits that would illuminate other LEDs, and then is split in two directions, one to supply a positive polarity to SCR 50 and one to provide a negative trigger pulse to IC timer 47 input 51 to a trigger comparator, the comparator output controlling a flip-flop which in turn supplies an output 52 pulse to activate SCR 50 and turn on an associated LED 53. Another voltage comparator, a threshold comparator, in cooperation with resistors 54 and capacitors 55 determines the length of time, preferably fifteen to twenty seconds, that the LED 53 will remain illuminated. Circuit 48 is automatically reset by NE555 timing cycle completion. A NE556 timer, also known commercially as an instant response timer IC, can be substituted for the NE555 timer in the electrical circuit described herein to achieve preset automatically timed LED 53 illumination. Electrical circuits 32 and 48 are not the only methods for LED 53 activation since other state of the are circuits are available for this task. Also, it should be noted that NE555 timer operation is limited to temperatures between 0° Celsius and 70° Celsius so if cold weather golf is desired, the electrical circuit arrangement 32 is preferred.

Figure 6:
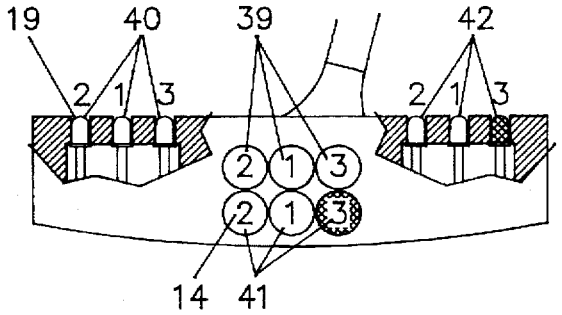
FIG. 6 is a golf club front face view with round button head design and break away portions exposing button associated LEDs.
Figure 7:
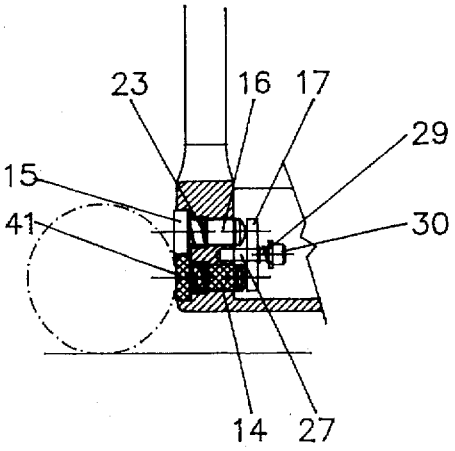
FIG. 7 is a golf club side vertical sectional view showing lower button member/golf ball impact.

Referring to FIG. 6, push button member 14 and LEDs 19 are numbered to show related push button member 14 LED 19 activation utilizing the electric circuit apparatus 32 or, in the alternative, the electrical circuit apparatus 48. In the illustrated embodiment, FIG. 6, top located push button members 39 activate top left side LEDs 40 and bottom located push button members 41 activate top right side LEDs 42. Middle push button members 14 designated number one in FIG. 6 represent club face 12 ideal impact areas, the top number one push button member 14 for short distances and the bottom number one push button member 14 for longer distances when using the putter 11. A golfer will observe the middle LEDs 19 labeled number one in FIG. 6 and will know if club/ball impact was with either top or bottom push button members 14. As illustrated in FIGS. 6 and 7, an impact on the bottom number three push button member 14 will result in activation of the top right side number three LED 42. LEDs 19 numbered two, one and three can be green, red and yellow, respectively so that green LED 19 illumination will immediately signal to the golfer left side club face 12 and golf ball impact, red LED 19 illumination will indicate club face 12 center and golf ball impact and yellow LED 19 illumination will signal right side club face 12 and golf ball impact. The LED 19 illumination will also immediately tell the golfer if the club face 12 golf ball impact was not only with the top or bottom but also with the center of the club face 12 since the same numbered LEDs 19 on the top left side 40 and top right side 41 will go on if a center impact occurs. In the case of center impact, both top and bottom push button members 14 will be depressed simultaneously activating associated number one LEDs 19.

Figure 8:
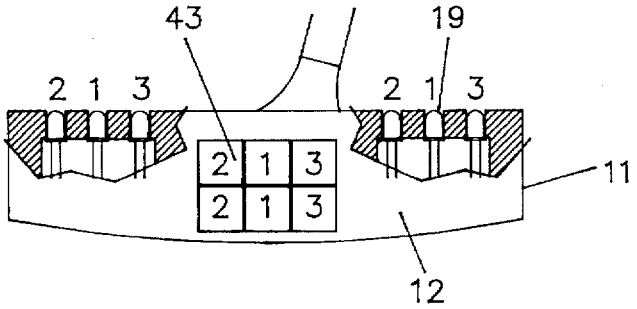
FIG. 8 is a golf club front face view with square button head design and break away portions exposing button associated LEDs.

FIG. 8 shows yet another embodiment of the present invention showing push button member 14 with square heads 43 that cover the club face 12 center, including the "sweet spot" having minimal space between push button members 14 square head 43 surface, thereby designed for an intermediate golfer who can benefit from precise ball location information. In this embodiment, information is conveyed to the golfer just as with the previously described circular push button member 14 golf club/golf ball impact detection system 10, with the detection system 10 remaining the same, the only difference being the push button members 14 square head 43.

Figure 9:
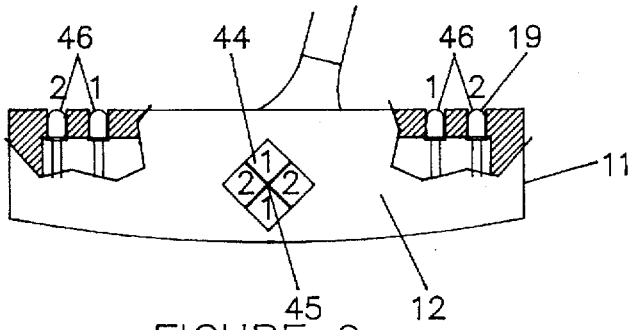
FIG. 9 is a golf club front face view with diamond shaped button head design and break away portions exposing button associated LEDs.

FIG. 9 depicts another embodiment of the present invention, designed for an experienced golfer who consistently impacts the club face 12 "sweet spot" center. This golf club/golf ball detection system 10 using a four diamond head 44 push button member 14 design enables detection of a precise golf club/golf ball impact location since the four diamond shaped heads 44 meet exactly at the golf club "sweet spot" center 45 where four associated LEDs 46 will be activated upon club/ball impact at this center. FIG. 9 shows LED 46 diamond head 44 association indicated by similar numbers; for example, an impact on diamond head 44 number two will result in illumination of LED 46 number two. LEDs 46 can be different colors with two LEDs 46 on the club face 12 left side and two on the club face 12 right side. By observing LED 46 illumination, the experienced golfer can make small swing adjustments to prevent slices, the ball drifting to the right or hooking the ball to the left.

Figure 10:
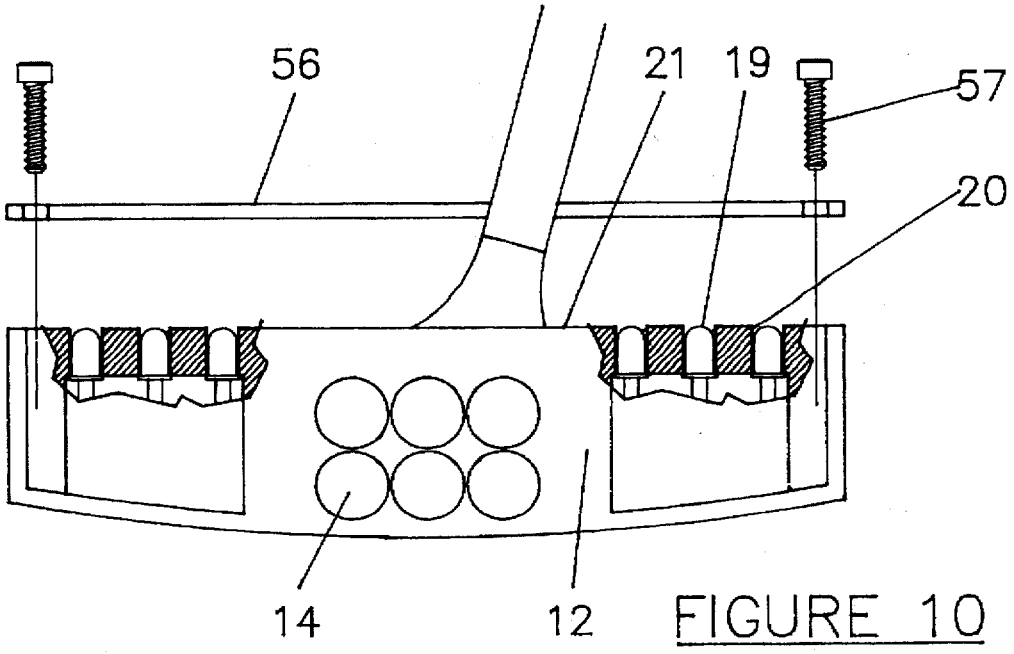
FIG. 10 is a golf club front face view with round button head design, break away portions exposing button associated LEDs and exploded top rim front surface with screw attachment means.

The golf club/golf ball impact detection system 11 described herein is with the right handed golfer in mind. Also, the conventional variations in club face 12 angles in "woods" and irons will not affect the golf club/golf ball impact detection system 10 efficiency since club face 12 design will be the same for all clubs, nor will there be any effect on the golf club/golf ball impact detection system 10 system even if the electrical circuit arrangement 32 and battery 18 placement varies depending on club head size FIG. 10 shows a method for securing a top wall 56 to a golf club body using screw means 57.

Even though the present invention has been described with respect to preferred embodiments thereof, it will be understood by those skilled in the art that the foregoing and various equivalent changes and modification in form and details may be made therein, without departing from the spirit and scope of the invention as fall within the full range of equivalents of the appended claims.

I claim:

1. A golf club/ball impact detection system contained within a conventional golf club head for golf practice and playing comprising:

a plurality of push button members located on a golf club face, each having a head portion and a shaft portion, said head portion fitted with a partially relaxed coiled spring arranged to urge said push button member head portion slightly above said club face surface area, and said shaft portion, provided with a tightly adhering safety ring to prevent said push button member escape after depression release, said shaft portion having a proximal end tip, that, upon said push button member depression will impact on an adjustable electrical conducting board;

a plurality of apertures, arranged as coaxial counterbores, first sized to slidingly receive said push button member head portion and then narrowed to slidingly receive said push button member shaft portion; said push button member head portion downward motion limited by a ledge defined by the first coaxial counterbore, a partially relaxed coiled spring acting in cooperation with said push button member shaft portion distal end urging said push button member head portion slightly above said club surface;

an adjustable electrical conducting board spaced from a golf club head top wall by screw means, at a distance slightly below said push button member's shaft portion end tip, said electrical conducting board sandwiched between screw associated coiled springs to allow conducting board flexibility and screw associated energy absorbing spacers that act to absorb excess golf club/ball impact force;

electrical conducting means arranged so that said push button member depression by a golf club/ball impact results in said shaft portion end tip impingement on said conducting board to complete an electrical circuit thereby illuminating associated light emitting diodes (LEDs) to signal golf club/ball impact position to a golfer; and a plurality of said LEDs located within a plurality of circular openings in a golf club face front wall top ridge, facing and visible to a practicing and playing golfer.

2. The golf club/ball impact detection system of claim 1 wherein said electrical circuit means comprises:

a power source means;

an electrical conducting means to illuminate said LED; and reset switch means for manually turning LED illumination off.

3. The golf club/ball impact detection system of claim 1 wherein said electrical circuit means comprises:

an instant response timer IC preset to illuminate associated LEDs for a predetermined period of time, as a steady light, and an external resistor and capacitor network to provide an electrical circuit for said timer IC operation.

4. The golf club/ball impact detection system of claim 1 wherein said push button member head portion is circular and an associated aperture is fitted to receive said circular head.

5. The golf club/ball impact detection system of claim 1 wherein said push button member head portion is square and an associated aperture is fitted to receive said square head.

6. The golf club/ball impact detection system of claim 1 wherein said push button member head portion is diamond shaped and an associated aperture is fitted to receive said diamond shaped head.

7. A method for detection of golf club/golf ball impact location which comprises:

depressing push button members through golf club/golf ball impact;

impacting said push button members distal portion tips on an adjustable electrical conducting board;

completing an electrical circuit;

illuminating LEDs; and observing said illumination in order to interpret golf club/golf ball impact location as high, low, left, right, center or off center.

8. The method of claim 7 wherein said golf club/golf ball impact results in more than one push button member simultaneous depression and more than one associated LED simultaneous illumination.

9. The method of claim 7 wherein said golf club/golf ball impact results in time delayed push button members depression and illumination of LEDs in order of impact time.

* * * * *